United States Patent [19]

Behr et al.

[11] Patent Number: 4,879,137

[45] Date of Patent: Nov. 7, 1989

[54] METHOD AND APPARATUS FOR ELECTROSTATIC COATING WITH CONDUCTIVE MATERIAL

[75] Inventors: Hans Behr, Stuttgart; Kurt Vetter, Remseck, both of Fed. Rep. of Germany

[73] Assignee: Behr Industrieanlagen GmbH & Co., Fed. Rep. of Germany

[21] Appl. No.: 198,184

[22] Filed: May 24, 1988

[30] Foreign Application Priority Data

May 27, 1987 [DE] Fed. Rep. of Germany ..... 3717929
Jul. 29, 1987 [DE] Fed. Rep. of Germany ..... 3725172

[51] Int. Cl.[4] ..... B05D 1/04; B05B 5/02; B05B 15/02

[52] U.S. Cl. ..... 427/27; 118/302; 118/626; 118/712; 427/421; 239/3; 239/112

[58] Field of Search ..... 239/112, 113, 3; 118/712, 302, 629, 626; 427/8, 33, 27, 426, 421, 31

[56] References Cited

U.S. PATENT DOCUMENTS

| | | | |
|---|---|---|---|
| 3,906,122 | 9/1975 | Krause et al. | 427/33 |
| 3,937,400 | 2/1976 | Krause | 239/3 X |
| 4,383,644 | 5/1983 | Spanjersberg et al. | 239/3 |
| 4,771,729 | 9/1988 | Planert et al. | 118/629 X |

*Primary Examiner*—Evan Lawrence
*Attorney, Agent, or Firm*—Reising, Ethington, Barnard, Perry & Milton

[57] ABSTRACT

In an apparatus for electrostatically coating workpieces with an electrically conductive coating material, an intermediate isolation tank (V) is conencted by electrically insulating conduit lines (LVA, LVB, LZA, LZB) between an electrically grounded coating material supply and a high voltage spraying device atomizer (Z). When the apparatus is in operation, the conduit lines (LVA, LVB, LZA, LZB) are alternately filled and emptied, such that the grounded supply and the high voltage atomizer (Z) are continuously insulated from each other. One embodiment utilizes an isolation tank V' which includes a metering cylinder (DZ) having a displaceable piston (2) for adjusting the coating material capacity of the tank (V') to the amount required to coat a single workpiece.

10 Claims, 3 Drawing Sheets

FW

LES
LES
VV
LVA
LVB
SP1
SP1
SM
DLV
DLV
SM
V'
V'
3
2
1
4
DZ
DZ
3
2
4
1
SP2
SP2
UV
LZA
LZB
HNV
Z
ES
ES

METHOD AND APPARATUS FOR ELECTROSTATIC COATING WITH CONDUCTIVE MATERIAL

FIELD OF THE INVENTION

The subject invention relates to a method and apparatus for coating workpieces with an electrically conductive coating material.

BACKGROUND ART

In prior art electrostatic coating apparatuses, particularly those for painting new motor vehicle bodies, a high voltage potential is applied to the spraying head of a rotary atomizer to produce an electrical charge in the sprayed coating material for improved adherence to a grounded workpiece. A problem has arisen, however, when a coating material of relatively good conductivity is used, for example a so-called water enamel. This problem results from the electrical insulation resistance in the conduit line connecting the spraying head with the paint supply system being too low if the paint supply system is at electrical ground potential. That is, the electrically conductive coating material inside the conduit lines will provide an electrical path between the high voltage spraying head and the grounded supply system.

In order to overcome this problem, it is theoretically possible to electrically insulate the entire supply system from electrical ground. This solution is practically undesirable, however, if the supply system includes of a plurality of storage vessels, each storage vessel supplying a different color of paint. Apart from the considerable cost of insulating the entire storage system, there is the possibility that an extensive supply system may have such a large capacity that there is a danger of explosive discharges at the spraying head. Furthermore, if the storage vessels are electrically insulated from ground, and thus maintained at the same high electrical potential as the spraying head, the tank can not be topped up, i.e., refilled, with paint without switching off the electrical current, unless costly additions such as intermediate tanks or the like are provided. Reference of such may be had in German Patent No. 29 00 660. In addition to this, many known systems require costly high output and high voltage sources.

According to another known method of overcoming the problem in question, the entire paint supply system, from the storage tank to the atomizer spraying head, is electrically grounded while the sprayed coating material is indirectly charged by external electrodes surrounding the spraying head, as shown in the prior art foreign patent EP No. OS 0171042. This method, however, may not be implemented on coating apparatuses where the coating material is directly charged through the spraying head.

In the prior art German Patent No. OS 30 14 221, each paint color to be electrostatically sprayed is provided with its own storage vessel. Each vessel is insulated from electrical ground and from the other vessels, and supplies the high potential spraying device through a paint color changer and connecting conduit line. At the end of the coating process with a given color, and before changing to another color, the connecting line is flushed with a solvent, e.g., water, and is dried with compressed air to maintain the required electrical insulation between the ground potential color changer and the high potential spraying device. However, this installation is costly and bulky, especially when a large number of different storage vessels are involved.

SUMMARY OF THE INVENTION

The subject invention provides a method for successively coating workpieces with an electrically conductive coating material comprising the steps of moving the coating material from a low electrical potential storage supply through an electrically nonconductive supply conduit line to an electrically insulated isolation tank, and moving the coating material from the isolation tank through an electrically nonconductive connecting conduit line to a high electrical potential spraying device for electrostatically coating a workpiece. The method is characterized by continuously insulating the low electrical potential storage supply from the high electrical potential spraying device by emptying the coating material from the supply conduit line prior to moving the coating material through the connecting conduit line and emptying the coating material from the connecting conduit line prior to moving the coating material through the supply conduit line.

The subject invention also contemplates an apparatus for successively coating workpieces with an electrically conductive coating material comprising a coating material color changer maintained at a low electrical potential and supplied with a coating material from storage supply, a spraying device maintained at a high electrical potential and receiving coating material from the color changer for electrostatically coating a workpiece. The subject apparatus is characterized by including an intermediate coating material isolation tank electrically insulated and disposed between the color changer and the spraying device, an electrically nonconductive supply conduit line for conveying coating material from the color changer to the isolation tank, an electrically nonconductive connecting conduit line for conveying coating material from the isolation tank to the spraying device, and means for emptying coating material from the connecting line before coating material is fed through the supply line and emptying coating material from the supply line before coating material is fed through the connecting line whereby the spraying device is continuously insulated in the color changer.

The subject invention overcomes the deficiencies in the prior art by allowing the paint supply system to remain at ground potential while the spraying device is maintained at a high electrical potential. The intermediate isolation tank isolates the coating material from creating an electrical path between the high potential spraying device and the low potential supply system. The subject invention alleviates the need for expensive electrical insulation of the coating material supply system and also provides an economical and efficient means for electrostatically coating workpieces.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
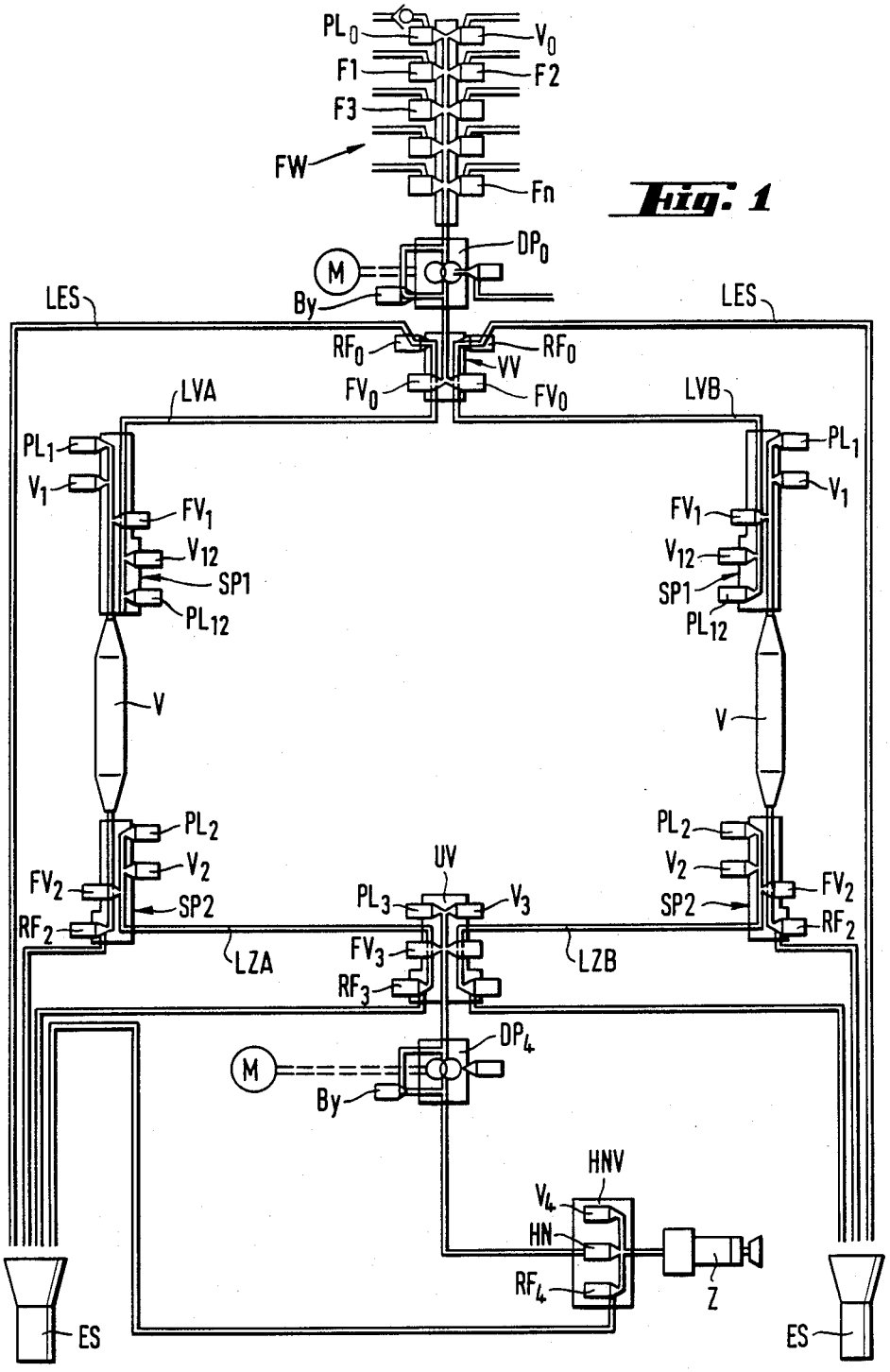
FIG. 1 is a schematic view of a coating apparatus according to the subject invention.

In the coating apparatus as shown in FIG. 1, a main needle-valve HNV for a paint spraying device, or atomizer, Z operates at an electrical potential of approximately 100 kV. A water enamel paint of any one of many different colors is supplied from separate storage vessels through a color changer FW, which is of a type well known in the art. The color changer FW includes a plurality of flow control valves F1, F2, F3 . . . Fn each associated with a storage vessel of a different color paint for supplying any desired number n of colors to the atomizer Z. A valve $V_0$ is provided in the color changer FW for introducing a flushing fluid, and a valve $PL_0$ is provided for introducing compressed air.

A distributor valve VV is fluidly connected to the color changer FW. A first flushable metering pump $DP_0$ is positioned between the color changer FW and the distributor valve VV. The first metering pump $DP_0$ is driven by a stepping motor M which includes an insulated driving shaft. A bypass conduit is provided about the metering pump $DP_0$, which is controlled by a valve $B_y$. Of course, is possible to provide, instead of the first metering pump $DP_0$, some other metering device controlled by a flow meter, as is well known in the art. The water enamel paint arriving from the color changer FW is selectively deflected by one of two preliminary color valves $FV_0$, disposed in the distributor valve VV, into one of two supply conduit lines LVA or LVB. The valves $FV_0$ are arranged in parallel and symmetrically with each other in the distributor valve VV. The distributor valve VV also includes two return valves $RF_0$ disposed in fluid communication with the respective valves $FV_0$, as will be described subsequently.

Each of the supply lines LVA and LVB run through a first flushing-valve arrangement SP1 and then into a flushable intermediate isolation tank V. The isolation tank V is adapted for internal pressurization and includes an outlet fluidly connected to a change-over valve UV. A second flushing-valve arrangement SP2 is disposed between the tank V and the change-over valve UV. Connecting conduit lines LZA and LZB extend from their respective second flushing valves SP2 to the change-over valve UV.

The first flushing valve arrangement SP1 includes two valves $V_1$ and $V_{12}$ for introducing a flushing fluid, two valves $PL_1$ and $PL_{12}$ for introducing compressed air, and a preliminary color valve $FV_1$. The second flushing device SP2 includes a valve $V_2$ for introducing a flushing fluid, a valve $PL_2$ for introducing compressed air, a preliminary color valve $FV_2$, and a return valve $RF_2$.

The right-hand branch circuit, as viewed from FIG. 1, which includes conduit lines LVB and LZB, is identical to the left-hand branch circuit including the conduit lines LVA and LZA, and contains identical first and second flushing valve arrangements SP1, SP2 with an intermediate flushable isolation tank V.

The change-over valve UV fluidly connects the two parallel left-hand and right-hand circuits, as shown in FIG. 1, to a second flushable metering pump $DP_4$ which may be identical to the first metering pump $DP_0$, i.e. it may have a stepping motor M with an insulated shaft, and a bypass line including a valve By to the main needle-valve HNV of the atomizer Z. The main needle-valve HNV includes a main needle HN, a valve $V_4$ for introducing flushing fluid, and a return valve $RF_4$.

The two intermediate isolation tanks V shown in FIG. 1 have only one volume, or capacity, corresponding to the amount of paint required to coat a single workpiece. In the case of motor vehicle bodies, for example, a volume of about 0.8 liters may suffice. The tank V is filled with a predetermined amount of paint by the first metering pump $DP_0$. The required volume of paint is stored, in the form of data, in an overriding computer control system associated with the apparatus which also controls the first metering pump $DP_0$ and automatically opens the appropriate valve in the color changer FW for the desired color. In addition to the volume of paint required for a workpiece, the computer control system also accounts for the volume within the sections of line LVA, LVB, LZA, LZB to be filled, which in the example mentioned may equal 0.1 liter. When smaller workpieces than vehicle bodies are to be coated, the computer control system may also be designed to allocate enough paint to the tanks V for coating a plurality of workpieces.

The lines LVA, LVB, LZA and LZB as well as others comprise tubular hoses made of a water-repellant electrically insulating material, and preferably of a synthetic material, for example PTFE (polytetrafluorethylene).

When the subject coating apparatus is in operation, the color changer FW, the first metering pump $DP_0$ and the distributor valve VV are at ground electrical potential, whereas the atomizer Z, the main needle-valve HNV, the second flushable metering pump $DP_4$, and the change-over valve UV are at a high electrical voltage potential. In this preferred example wherein the change-over valve UV is always at a high electrical potential, the two isolation tanks V constantly alternate their electrical potentials between high and low, in response to the electrically conductive coating material being supplied from either the grounded paint supply system or to the high voltage atomizer Z. Alternatively, it is possible to provide the alternating insulation, i.e., alternating high to low potential, as described above between the tanks V and the atomizer Z, in the conduit line between the change-over valve UV and the atomizer Z.

The method of operation will be addressed presently by reference to the various operating phases occurring either consecutively or simultaneously.

The isolation tank V disposed between the supply line LVA and the connecting line LZA is filled with paint coating material through one of the valves, say for example F1, of color change FW. The paint extends from the valve F1 through the first metering pump $DP_0$, the preliminary color valve $FV_0$ of the distributor valve VV, the supply line LVA, and to the preliminary color valve $FV_1$ of the first flushing valve arrangement SP1. From the preliminary color valve FV1 the filling continues through to the preliminary color valve $FV_2$ of the flushing valve arrangement SP2, thus filling to capacity the isolation tank V.

After the tank V has been filled with the paint, the preliminary color valve $FV_0$ of the distributor valve VV is closed and the color changer FW is flushed clean. For this purpose, a solvent, which in the case of a water-soluble paint may consist mainly of water, is fed through the flushing valve $V_0$ of the color changer FW, and consequently, into the color changer FW. The solvent passes first through the metering pump $DP_0$ and out the return valve $RF_0$ of the distributor valve VV, carrying along any existing paint residues through a line LES and ultimately into a waste disposal device ES. Immediately thereafter, or consecutively therewith, air for drying the flushed passages is injected under pressure through the valve $PL_0$ of the color changer FW to expel all traces of the solvent from the internal passages. The valve $PL_0$, as shown in FIG. 1, is in the form of a non-return valve.

Next, once the isolation tank V has been filled, it is essential to provide proper electrical insulation in the supply line LVA, between the distributor valve VV and the flushing valve arrangement SP1. This proper insulation is provided when the supply line LVA is completely flushed and dried. For this reason, the flushing valve $V_{12}$ and the compressed air valve $PL_{12}$ of the first valve arrangement SP1, are opened either simultaneously or consecutively to introduce the solvent into the supply line LVA. The solvent and the compressed air flush out any paint residues remaining in the line LVA, and then pass through the valves $FV_0$ and $RF_0$ of the distributor valve VV into the waste disposal line LES. After the flow of solvent has been shut off by closing the flushing valve $V_{12}$, the whole passage running from the air valve $PL_{12}$, through the distributor valve VV, into the waste disposal line LES is blown completely dry with air. Once this operation is completed, the high potential change-over valve UV will be electrically insulated from the ground potential distributor valve VV while the electrically conductive paint extends through the connecting line LZA.

Now that the supply line LVA is empty, the paint may be fed from the isolation tank V, which is pressurized by the air valve $PL_1$, through the preliminary color valve $FV_2$ of the second flushing valve arrangement SP2, and then through the connecting line LZA, a preliminary color valve $FV_3$ of the change-over valve UV, the conduit lines running through the second metering pump $DP_4$ to the main needle-valve HNV, and finally to the atomizer Z. At this moment, the tank V is at high voltage due to the electrical conductivity of the paint in the connecting line LZA, but is electrically insulated from the grounded paint supply system due to the empty supply line LVA.

Preferably, the paint coating material is first pressured from the tank V only as far as the closed main needle-valve HNV of the atomizer Z, and preferably through the bypass valve By of the second metering pump $DP_4$. This pressurized path may extend to the return valve $RF_4$ of the main needle-valve HNV and beyond. In this preferred method of operation, it is only after the paint has reached the main needle-valve HNV that the main needle HN is opened so that paint is pumped by the second metering pump $DP_4$ to the atomizer Z for spraying. At this time, the pressure in the tank V may be in the order of 2.5 to 4 bars.

After the painting operation has been completed for a workpiece, the atomizer Z is flushed both internally, i.e., by the change-over valve UV as far as main needle-valve HNV, and also externally, i.e., at the spraying head bell plate of the atomizer Z via the air valve $PL_3$ and the solvent valve $V_3$ of the change-over valve UV. Paint residues located within the conduit lines running between the change-over valve UV and the main needle-valve HNV are carried away in the solvent through the return valve $RF_4$ and ultimately to the waste disposal device ES.

In the preceding description of the preferred operation, the atomizer Z was supplied from the isolation tank V of the left-hand branch, which includes the supply line LVA and the connecting line LZA as shown in FIG. 1. The right-hand branch including the supply line LVB and the connecting line LZB may be prepared, in the same manner as the left-hand branch, for coating the next motor vehicle body with a paint of the same or different color. A valve, say for example the valve F2, of the color changer FW is opened and the associated coating material is fed through the first metering pump $DP_0$ to the right-hand isolation tank, which has already been flushed and made ready for coating a body. The paint travels through the right-hand preliminary color valve of the distributor valve VV, through the supply line LVB and the right-hand first flushing valve arrangement, and finally into the right-hand isolation tank.

Then, the color changer FW and the first metering pump $DP_0$ are flushed with solvent in the manner already described.

Before paint is fed to the atomizer Z from the right-hand branch isolation tank, the electrical insulating section formed by the supply line LVB extending between the right-hand tank in FIG. 1 and the distributor valve VV is flushed with solvent and then blown completely dry as previously described in connection with the left-hand branch supply line LVA. When the supply line LVB has been completely cleansed of paint, the requisite electrical insulation is provided between the ground potential distributor valve VV and the high electrical potential change-over valve UV.

The coating material from the right-hand branch tank, containing the new color, may next be urged under pressure from the right-hand isolation tank to the main needle-valve HNV. This causes the right-hand tank to become placed under high voltage due to the electrical conductivity of the paint. The second metering pump $DP_4$ then pumps this coating material to the atomizer Z which sprays it onto the next workpiece body.

While the coating material is passing from the right-hand isolation tank to the main needle-valve HNV of the atomizer Z, it is desirable for the left-hand isolation tank V of FIG. 1, which contained the first color of paint, to be flushed with the cleaning solvent. To this end, solvent is introduced through the valve $V_1$ of the flushing valve arrangement SP1 and moved through the isolation tank V to the return valve $RF_2$ of the flushing valve arrangement SP2, and finally passing into the line running to the waste disposal ES. Simultaneously, or immediately thereafter, air is blown through the valve $PL_1$ and the tank V to dry the interior passages and thus prepare for a new color of paint.

Also, while paint is being fed from the right-hand branch isolation tank to the main needle-valve HNV, the insulating section formed by the empty connecting line LZA is flushed via the valves $PL_2$ and $V_2$ of the flushing arrangement SP2, along with the return valve $RF_3$ of the change-over valve UV. Any paint residues present are fed to the waste disposal device ES through the conduit line connected to the return valve $RF_3$.

As soon as the line LZA is dry, and thus electrically insulative, the initial operating phase of connecting the left-hand isolation tank V to the paint supply system for refilling with a new color paint can be recommenced. It is to be understood that as soon as the second body has been coated, the atomizer Z is reflushed. While the next body is being coated by paint supplied from the left-hand isolation tank V, the right-hand isolation tank is flushed and the insulating section, formed by the empty line LZB, is flushed and dried.

All of these procedures are repeated cyclically from one body to the next and may easily be controlled by a switching sequence ensuring satisfactory high voltage potential insulation from ground.

If, in the case of the method described above in conjunction with FIG. 1, the isolation tank V has a given invariable paint capacity, the tank V must obviously have a large enough capacity to accommodate paint to cover the surface area of the workpiece to be coated. In many cases, however, the coating apparatus is capable of coating various workpieces of different sizes, i.e., sometimes for larger and other times for smaller sized workpieces. A typical example of this is the quantity coating of different sized motor vehicle bodies. When the coating apparatus is used for painting smaller workpieces, the intermediate isolation tank V is filled to only partial capacity with paint since the required amount of paint is less than the capacity of the tank V. After the associated workpiece has been coated with the paint in this tank V, the tank V is completely filled with solvent for cleaning purposes. As a result of this, more solvent is used than is actually necessary, which will be especially appreciated when considered with the continuous painting of a multitude of workpieces. Also, because of the resulting pollution from the contaminated solvent, this is undesirable. Moreover, because of the long filling time of the tank V with solvent, the cleaning process takes more time and this must be subtracted from the rate at which the quantity-coating process can be performed.

Figure 2:
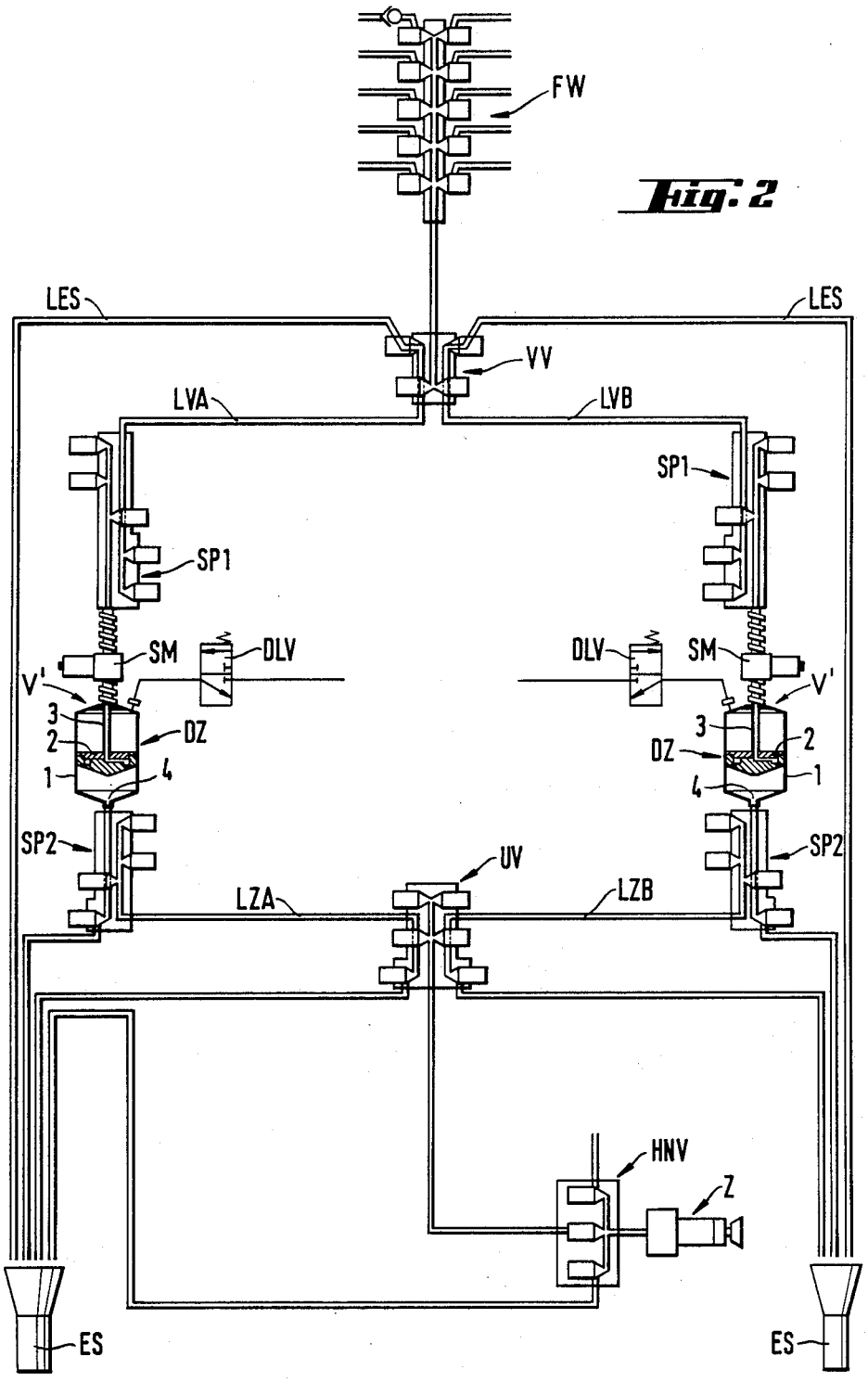
FIG. 2 is a schematic view of an alternative embodiment of the subject coating apparatus.

The coating apparatus shown in FIG. 2 corresponds substantially to that shown in FIG. 1, however, an isolation tank V' is used and includes a metering cylinder DZ capable of reducing the amount of solvent required for cleaning, and consequently the time used in cleaning the tank V', to a minimum.

As in the coating apparatus shown in FIG. 1, when the operation is in progress, the color changer FW and the distributor valve VV are always at ground potential, and the atomizer Z along with the main needle-valve HNV and the change-over valve UV are always at a high voltage potential. The left-hand and right-hand branches with their associated metering cylinders DZ alternate between high and ground potential constantly and cyclically, depending upon the electrical connection path created by the conductive paint within the conduit lines LVA, LVB, LZA, LZB between the grounded paint supply system and the atomizer Z. The color changer FW and the atomizer Z are thus kept electrically insulated from each other at all times by alternately filling and emptying the supply lines LVA, LVB and the connecting lines LZA, LZB lines at the inlet and outlet ends of the two metering cylinders DZ.

Figure 3:
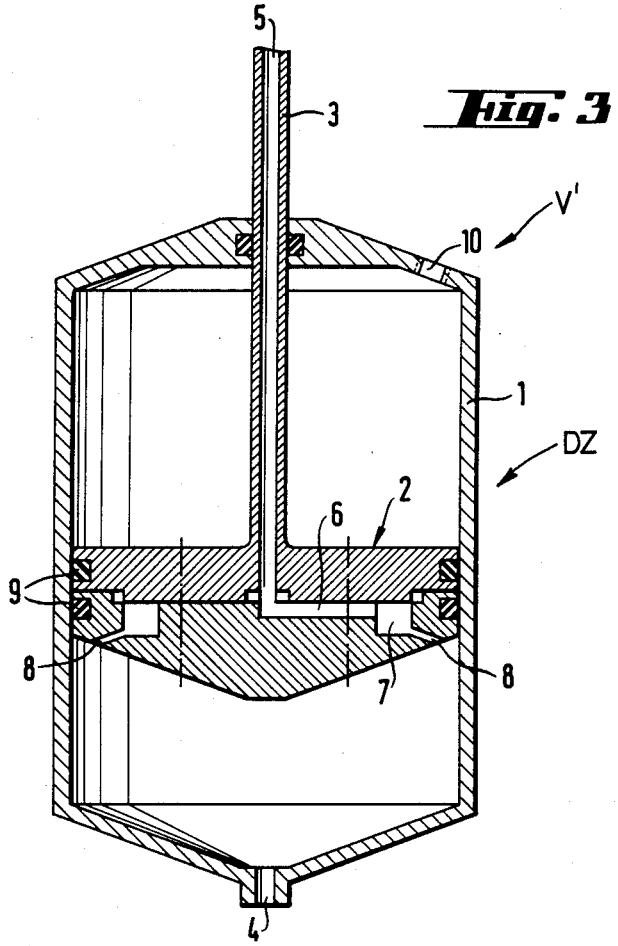
FIG. 3 is a cross-sectional view of a metering cylinder according to the alternative embodiment of the subject coating apparatus of FIG. 2.

Before the coating process begins, the paint capacity of the two metering cylinders DZ is adjusted to the amount of paint required, which, of course, is defined largely by the surface area of the workpiece to be coated. The metering cylinder DZ is shown in FIG. 3 comprising a cylinder vessel 1 and a displaceable piston 2 slideably disposed in the cylinder vessel 1. The piston 2 is disposed at one end of a piston rod 3 which passes sealingly through an upper end wall of the cylinder vessel 1. A lower end wall of the cylinder vessel 1, opposite the upper end wall, includes an outlet 4 leading to the flushing valve arrangement SP2, as shown in FIG. 2. A fluid inlet is located in a duct passage 5 extending axially through the interior of the piston rod 3, which is in the form of a hollow tube. The duct 5 opens into a connecting duct 6 disposed within the piston 2. The connecting duct 6 leads from the duct 5 to an annular duct 7 adjacent the peripheral surface of the piston 2 and disposed concentrically therein. A plurality of discharge nozzles 8 are fed from the annular duct 7 and are directed toward the inner wall of the cylinder vessel 1, outwardly and at a slight angle downwardly toward the outlet 4. The discharge nozzles 8 open onto the end face of piston 2 adjacent the inner wall of the cylinder vessel 1. Instead of a plurality of discrete nozzles 8, it is also possible in the alternative to employ a continuous annular aperture. As shown in FIG. 3, the piston 2 may be comprised of two members, an upper member being integral with piston rod 3 and a lower member adjacent the outlet 4 and being attached to the upper member. In this embodiment, the ducts 6 and 7 comprise the appropriately shaped recesses, or grooves, in the inner attaching surface of the lower member. The peripheral surface of the piston 2 supports two sealing rings 9 which slide along the inner wall of the cylinder vessel 1. As shown in FIG. 3, the space between the lower end face of the piston 2 and the outlet 4 of the cylinder vessel 1 defines the adjustable volume for receiving the paint. A compressed-air connection 10 is provided into the cylinder vessel in the space above the piston 2.

In order to adjust the volume, or paint capacity, within the cylinder vessel 1, a spindle-drive SM, shown in FIG. 2, is connected to the piston rod 3. A stepping motor is powered by pulses produced from the electronic control system of the apparatus. Before the start of the coating process, the spindle-drive SM moves the piston 2 into the correct position within the cylinder vessel to provide the appropriate paint capacity This appropriate paint capacity corresponds with information of the body size to be coated, and is stored in the form of data in the electronic control system. It is also possible to employ a toothed-rack or some other system instead of the spindle-drive SM.

During the coating operation, the metering cylinder DZ is filled, emptied and cleaned substantially as described hereinbefore. Thus, one of the two branches is first filled through the color changer FW and into the appropriate metering cylinder DZ. Since the metering cylinder DZ may simply be filled right up, as the capacity has been previously adjusted, there is no need to use a metering pump. After the color changer FW and the relevant supply line LVA or LVB have been flushed with solvent and dried, the paint is fed from the metering cylinder DZ to the atomizer Z.

The metering cylinder DZ must then be flushed. It would be sufficient for this purpose to pass solvent from the flushing valve arrangement SP1, through the space between the piston 2 and the outlet 4, and then out the outlet 4 to the flushing valve arrangement SP2. In order to conserve solvent, however, it is preferable to spray the solvent from the discharge nozzles 8 onto the inner wall of cylinder vessel while the piston 2 is simultaneously moved toward the outlet 4. In this manner, any paint adhering to the inner wall of the cylinder vessel 1 is scraped off with the solvent by the sealing rings 9 disposed in the peripheral surface of the piston 2. The piston 2 may move until it comes to a stop against the matingly shaped end wall of the cylinder vessel This cleaning movement of the piston 2 may be accelerated by means of compressed air introduced through the connection 10 which acts upon the upper driving surface of the piston 2. Control valves DLV are provided for the compressed air drive introduced through the connection 10 and are shown in FIG. 2. The change in the design of the piston drive needed for this accelerated method of the cleaning operation is not shown and forms no part of the subject invention. The piston 2, after the cleaning operation is completed, is then returned to the position predetermined by the control system.

There are various methods of venting the metering cylinder DZ during the filling and cleaning operations. For instance, venting may be provided for by one of the valves of the second flushing valve arrangement SP2 which open to the waste disposal or to the change-over valve UV, or possibly through the atomizer Z itself.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference characters are merely for convenience and are not to be in any way limiting, the invention may be practiced otherwise than as specifically described.

What is claimed is:

1. A method for successively coating workpieces with an electrically conductive coating material comprising the steps of: moving a quantity of coating material from a storage supply to an intermediate isolation tank (V'); moving the quantity of coating material from the isolation tank (V') to a spraying device (Z) for coating a workpiece; and characterized by adjusting the capacity of the isolation tank (V') prior to moving the coating material to the tank to correspond with the quantity of coating material to be supplied from the storage supply and moved to the spraying device (Z).

2. A method as set forth in claim 1 further characterized by electrically grounding the storage supply; maintaining the spraying device (Z) at a high electrical potential; and electrically insulating the metering cylinder (DZ) of the isolation tank (V').

3. A method as set forth in claim 2 further characterized by moving a piston (2) disposed in the metering cylinder (DZ) to adjust the coating material capacity of the isolation tank (V).

4. A coating apparatus for successively coating workpieces with an electrically conductive coating material comprising: an isolation tank (DZ) having a coating material capacity for storing coating material supplied thereto; a spraying device (Z) in fluid communication with said isolation tank (V') for spraying coating material from said isolation tank (V') onto a workpiece; fluid expulsion means ($PL_1$) associated with said isolation tank (V') for applying a pressurized gas to the coating material in said isolation tank (V') to move the coating material from said location tank (V') to said spraying device (Z); and said isolation tank (V') including metering cylinder means (DZ) for adjusting the coating material capacity of said isolation tank (DZ) to a predetermined volume before coating material is supplied thereto and for maintaining the capacity at the predetermined volume while said fluid expulsion means ($PL_1$) moves the coating material therefrom.

5. An apparatus as set forth in claim 4 further characterized by said metering cylindrical means (DZ) including an enclosed cylinder vessel (1) having a coating material inlet (5) thereto and a coating material exit (4) therefrom, a piston (2) slideably disposed in said cylinder vessel (1), and means (SM) for moving said piston (2) relative to said cylinder vessel (1) to adjust the coating material capacity of said isolation tank (V').

6. An apparatus as set forth in claim 5 further characterized by said metering cylinder means (DZ) including an elongated tubular piston rod (3) having an axially extending inlet duct (5), said piston rod (3) fixedly disposed on said piston (2) and moveable therewith and extending through said cylinder vessel (1) for engagement with said means (SM) for moving said piston (2)

7. An apparatus as set forth in claim 6 further characterized by said piston (2) including internal ducts (6, 7) in fluid communication with said piston rod inlet duct (5), and at least one discharge outlet (8) disposed adjacent an outer lateral edge of said piston (2) and extending between said internal ducts (6, 7) and an exterior face of said piston (2) for discharging into said isolation tank (V').

8. An apparatus as set forth in claim 7 further characterized by said means (SM) for moving said piston (2) including a spindle-drive (SM).

9. An apparatus as set forth in either claims 4 or 8 further characterized y including an electrically insulating supply conduit line (LVA, LVB) disposed between said storage supply and said isolation tank (V'), and an electrically insulating connecting conduit line (LZA, LZB) disposed between said isolation tank (V') and said spraying device (Z).

10. A coating apparatus for successively coating workpieces with an electrically conductive coating material comprising: an isolation tank (V') having a coating material capacity for storing coating material supplied thereto; a spraying device (Z) in fluid communication with said isolation tank (V') for spraying coating material from said isolation tank (V') onto a workpiece; a conduit extending between said isolation tank (V') and said spraying device (Z) for conducting a flow of coating material; metering pump means ($DP_4$) associated with said conduit for moving the coating material from said isolation tank (V') t o said spraying device (Z); and said isolation tank (V') including metering cylinder means (DZ) for adjusting the coating material capacity of said isolation tank (V') to a predetermined volume before coating material is supplied thereto and for maintaining the capacity at the predetermined volume while the metering pump means ($DP_4$) moves the coating material therefrom.

* * * * *